US007303431B2

(12) United States Patent
Lin

(10) Patent No.: US 7,303,431 B2
(45) Date of Patent: Dec. 4, 2007

(54) CONNECTOR SECURING APPARATUS

(75) Inventor: Gwo-Ching Lin, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/219,270

(22) Filed: Sep. 2, 2005

(65) Prior Publication Data

US 2006/0057887 A1 Mar. 16, 2006

(30) Foreign Application Priority Data

Sep. 16, 2004 (CN) ..... 2004 2 0088469 U

(51) Int. Cl.
*H01R 13/60* (2006.01)

(52) U.S. Cl. ..... 439/527; 439/372

(58) Field of Classification Search ..... 439/527, 439/372

See application file for complete search history.

(56) References Cited

U.S. PATENT DOCUMENTS 3,087,984 A * 4/1963 Waranch ..... 174/135
5,364,287 A * 11/1994 Weber ..... 439/358
5,373,416 A * 12/1994 Tran ..... 361/674
6,089,876 A 7/2000 Kuwahara et al.
6,102,727 A 8/2000 Kawaguchi et al.
6,296,493 B1 * 10/2001 Michiya ..... 439/66
6,669,156 B2 * 12/2003 East et al. ..... 248/300
6,851,964 B2 * 2/2005 Miller ..... 439/372
6,912,120 B2 * 6/2005 Kim et al. ..... 361/681
6,935,883 B2 * 8/2005 Oddsen, Jr. ..... 439/374

* cited by examiner

*Primary Examiner*—Truc Nguyen
(74) *Attorney, Agent, or Firm*—Jeffrey T. Knapp

(57) ABSTRACT

A connector securing apparatus (10) for securing a first connector (20) to a liquid crystal display device (30) includes a body portion (14), a pair of supporting portions (12) extending from opposite ends of the body portion and a securing portion (16) extending from a main portion (13) of the body portion. In use, the first connector is inserted in a second connector (40) of the liquid crystal display device. Then, the supporting portions engage with the first connector and the securing portion is fixed to a housing (32) of the liquid crystal display device. Thereby, the first connector can be located in the second connector firmly, ensuring good electrical signal transmission. Furthermore, the connector securing apparatus and the first connector are two separate pieces. This enables the first connector to have a simple structure, so that the first connector can be used in a wide variety of different applications.

18 Claims, 4 Drawing Sheets

CONNECTOR SECURING APPARATUS

BACKGROUND

The invention relates to a connector securing apparatus that can secure a connector to an electronic device effectively.

Electrical connectors generally have connector securing apparatuses, which latch matable electrical connectors to each other to maintain secure engagement between the electrical connectors. A conventional connector includes a housing, a plurality of contacts mounted in the housing, and a pair of clips having U-shaped cross-sectional configurations mounted on opposite ends of the housing. In this connector, the clips are the connector securing apparatuses. In use, when the connector engages with a connectable plate, such as a liquid crystal glass plate, the clip holds the connectable plate and the housing together. This ensures good electrical signal transmission between the connectable plate and the connector.

Another conventional connector includes a housing, a plurality of contacts mounted on the housing, and a latching member mounted on the housing and being freely pivotable relative to the housing. Tabs on the latching member are oriented at a shallow angle with respect to a main body of the latching member. In use, when the latching member is moved to an open or unlatched position, the main body is held in a relatively upright state in a predetermined position. Then, after a mating connector has been completely inserted into the connector, the latching member is moved to a closed or latched position, and is latchably engaged with the mating connector. This ensures good electrical signal transmission between the mating connector and the connector.

However, each of the above-described connector securing apparatuses is an integral portion of the connector itself. This makes the structure of the connector rather complex. In addition, the range of compatible connections available for the connector is limited. That is, the connector cannot be used in certain incompatible applications.

What is needed, therefore, is a connector securing apparatus that is a piece separating from an associated connector, which connector securing apparatus can secure the connector to an electronic device effectively.

SUMMARY

In one embodiment, a connector securing apparatus for securing a first connector to a liquid crystal display device includes a body portion, a pair of supporting portions extending from opposite ends of the body portion and a securing portion extending from a main portion of the body portion. A positioning bulge is formed on the securing portion and a locating hole is defined in the securing portion. Correspondingly, a positioning hole and a threaded hole are formed in the liquid crystal display device.

In use, the first connector is inserted in a second connector of the liquid crystal display device. Then, the supporting portions of the connector securing apparatus engage with the first connector. The positioning bulge of the connector securing apparatus is positioned in the positioning hole of the liquid crystal display device and the locating hole of the connector securing apparatus is aligned with the threaded hole of the liquid crystal display device. After that, a screw is inserted through the locating hole of the connector securing apparatus and engaged in the threaded hole of the liquid crystal display device. Thus, the securing portion of the first connector is fixed to the liquid crystal display device. Thereby, the first connector can be located in the second connector firmly, ensuring good electrical signal transmission. Furthermore, the connector securing apparatus and the first connector are two separate pieces. This enables the first connector to have a simple structure, so that the first connector can be used in a wide variety of different applications.

Other advantages and novel features will become more apparent from the following detailed description of preferred embodiments when taken in conjunction with the accompanying drawings, in which:

Figure 1:
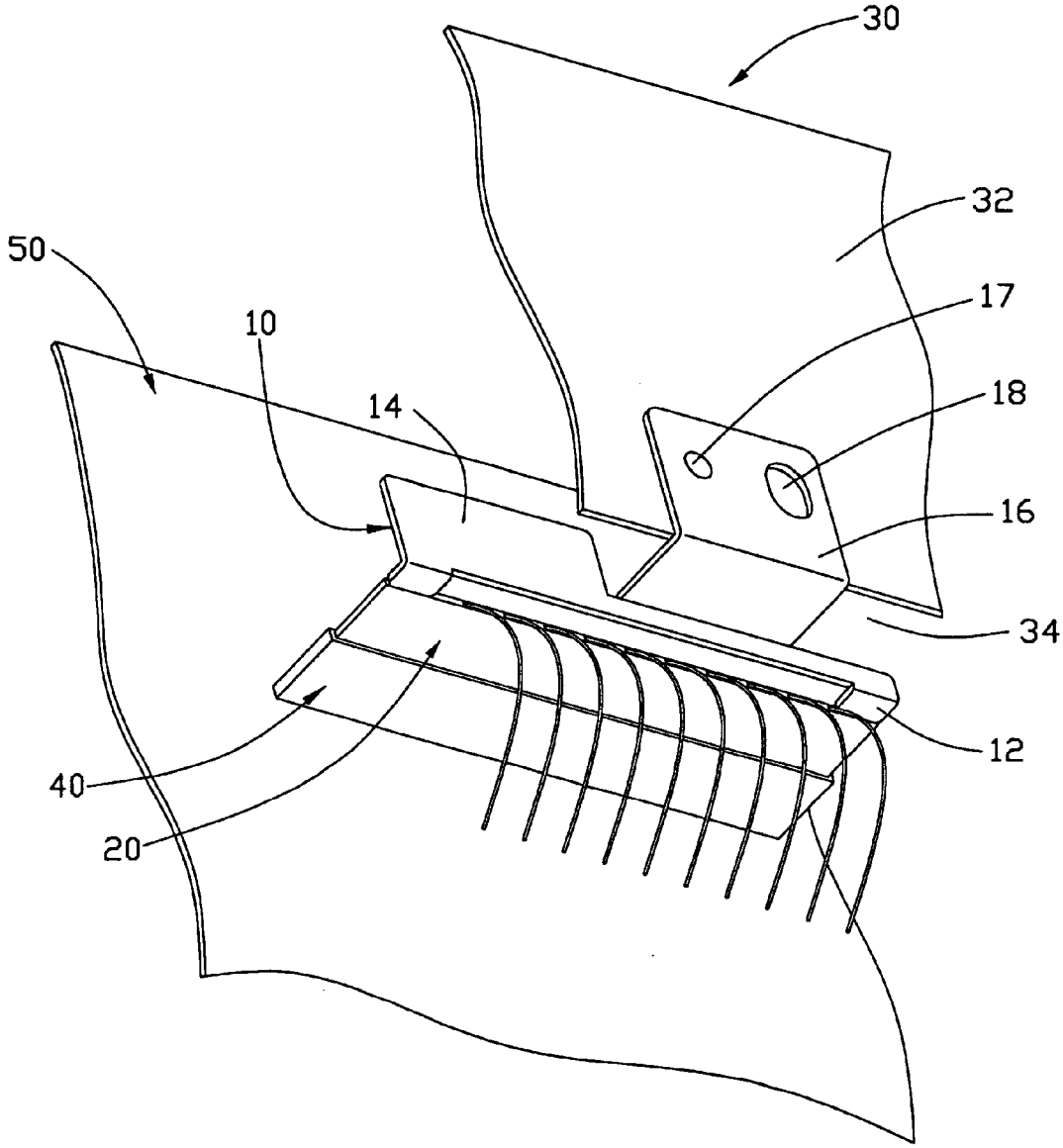
FIG. 1 is an isometric view of an application environment of a connector securing apparatus in accordance with a first embodiment of the present invention, showing the connector securing apparatus interengaged between a first connector and a housing of an LCD (Liquid Crystal Display) device, the first connector being connected with a second connector mounted on a circuit board of the LCD device.

Corresponding reference characters indicate corresponding parts throughout the several views. The exemplifications set out herein illustrate at least two preferred embodiments of the invention. However, such exemplifications are not to be construed as limiting the scope of the invention in any manner.

DETAILED DESCRIPTION OF PREFERRED EMBODIMENTS

Reference will now be made to the drawings to describe embodiments of the present invention in detail.

Figure 2:
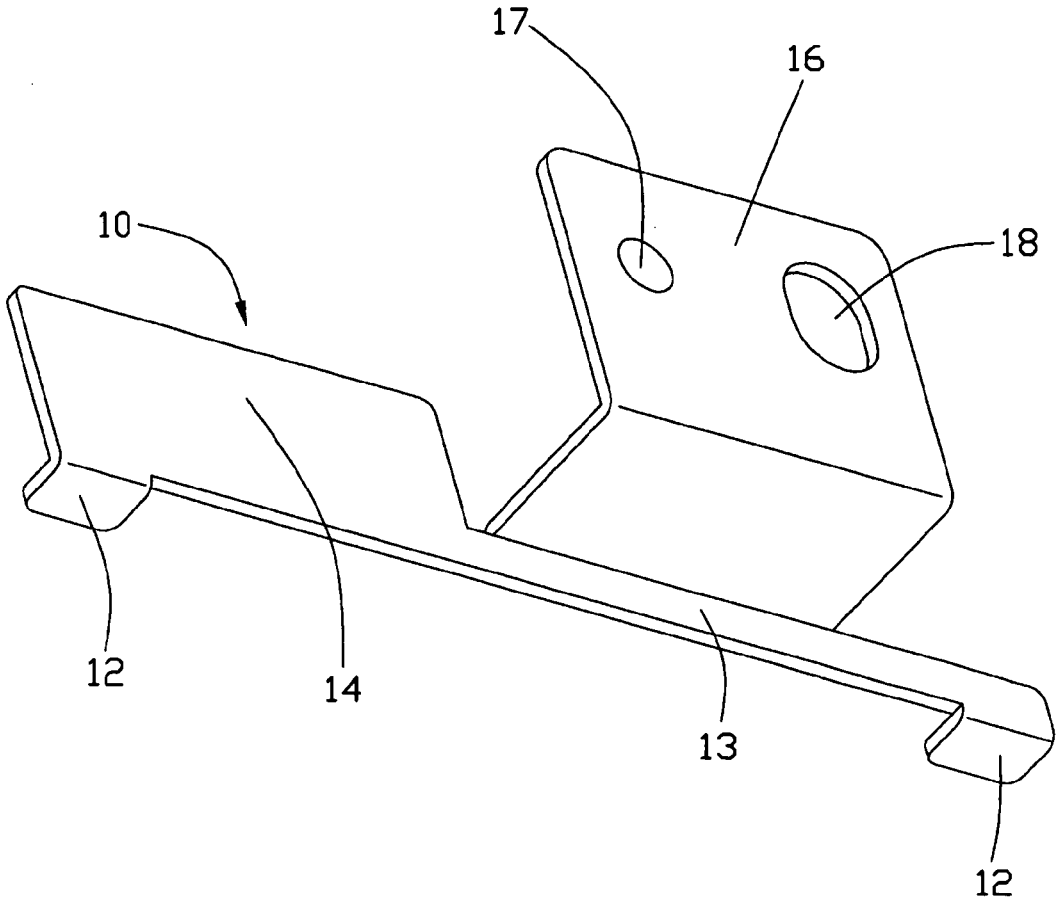
FIG. 2 is an enlarged, isometric view of the connector securing apparatus of FIG. 1.
Figure 3:
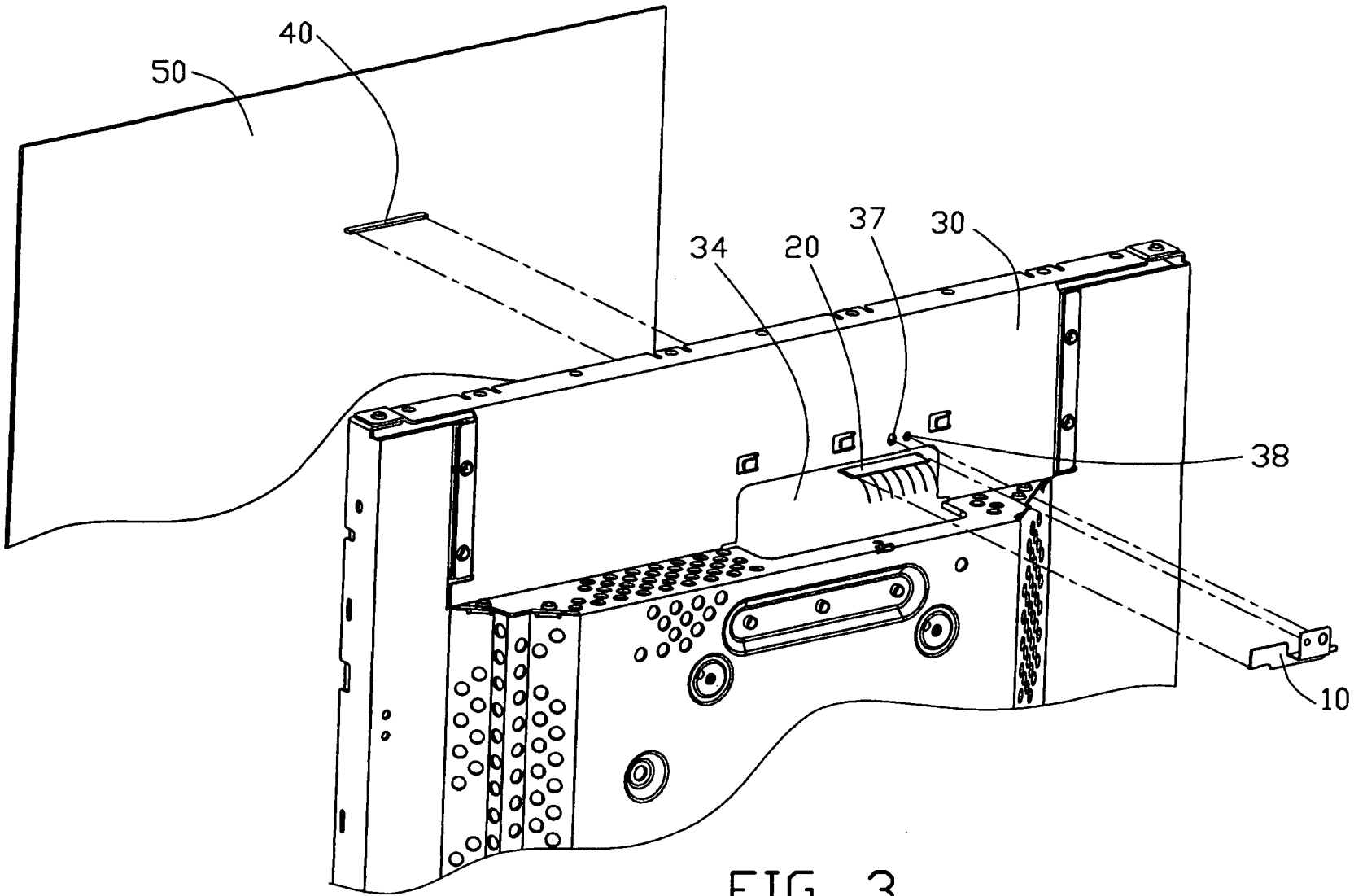
FIG. 3 is an exploded, isometric view of the connector securing apparatus and application environment of FIG. 1, showing major portions of the circuit board and the housing.

Referring to FIGS. 1, 2 and 3, a connector securing apparatus 10 in accordance with a first embodiment of the present invention is used for securing a first connector 20 to an electronic device such as a liquid crystal display device 30. The liquid crystal display device 30 includes a housing 32 used as a supportive means, and a circuit board 50 used as an electronic component positioned in the housing 32. The housing 32 has an opening 34, and a second connector 40 is located at the circuit board 50.

The connector securing apparatus 10 includes a body portion 14, a pair of supporting portions 12 extending from opposite ends of the body portion 14, and a securing portion 16 extending from a main portion 13 of the body portion 14. The supporting portions 12 are bent from the body portion 14, and extend in an inward direction for a preset length. The securing portion 16 is bent from the main portion 13, and initially extends in an outward direction for another preset length and then in an upward direction. A positioning bulge 17 is formed on an inward face of the securing portion 16, and a locating hole 18 is defined in the securing portion 16. Correspondingly, a positioning hole 37 and a threaded hole 38 are defined in the housing 32 of the liquid crystal display device 30.

In use, a first end of the first connector 20 is inserted in the second connector 40 via the opening 34 of the housing 32. The mated first and second connecter 20, 40 has a preset total extension length away from the circuit board 50. Then, the supporting portions 12 of the connector securing apparatus 10 engage with a second end of the first connector 20, the second end being opposite to the first end. The positioning bulge 17 of the connector securing apparatus 10 is positioned in the positioning hole 37 of the housing 32, and the locating hole 18 of the connector securing apparatus 10 is aligned with the threaded hole 38 of the housing 32. After that, a screw (not shown) is inserted through the locating hole 18 of the connector securing apparatus 10 and engaged in the threaded hole 38 of the housing 32. Thus, the securing portion 16 of the first connector 20 is fixed to the housing 32 of the liquid crystal display device 30 and the connector securing apparatus 10 is properly located between the second end of the first connector 20 and the housing 32 by means of the Supporting portions 12 and the securing portion 16. Thereby, the first connector 20 can be located in the second connector 40 firmly, ensuring good electrical signal transmission. Furthermore, the connector securing apparatus 10 and the first connector 20 are two separate pieces. This enables the first connector 20 to have a simple structure, so that the first connector 20 can be used in a wide variety of different applications.

Figure 4:
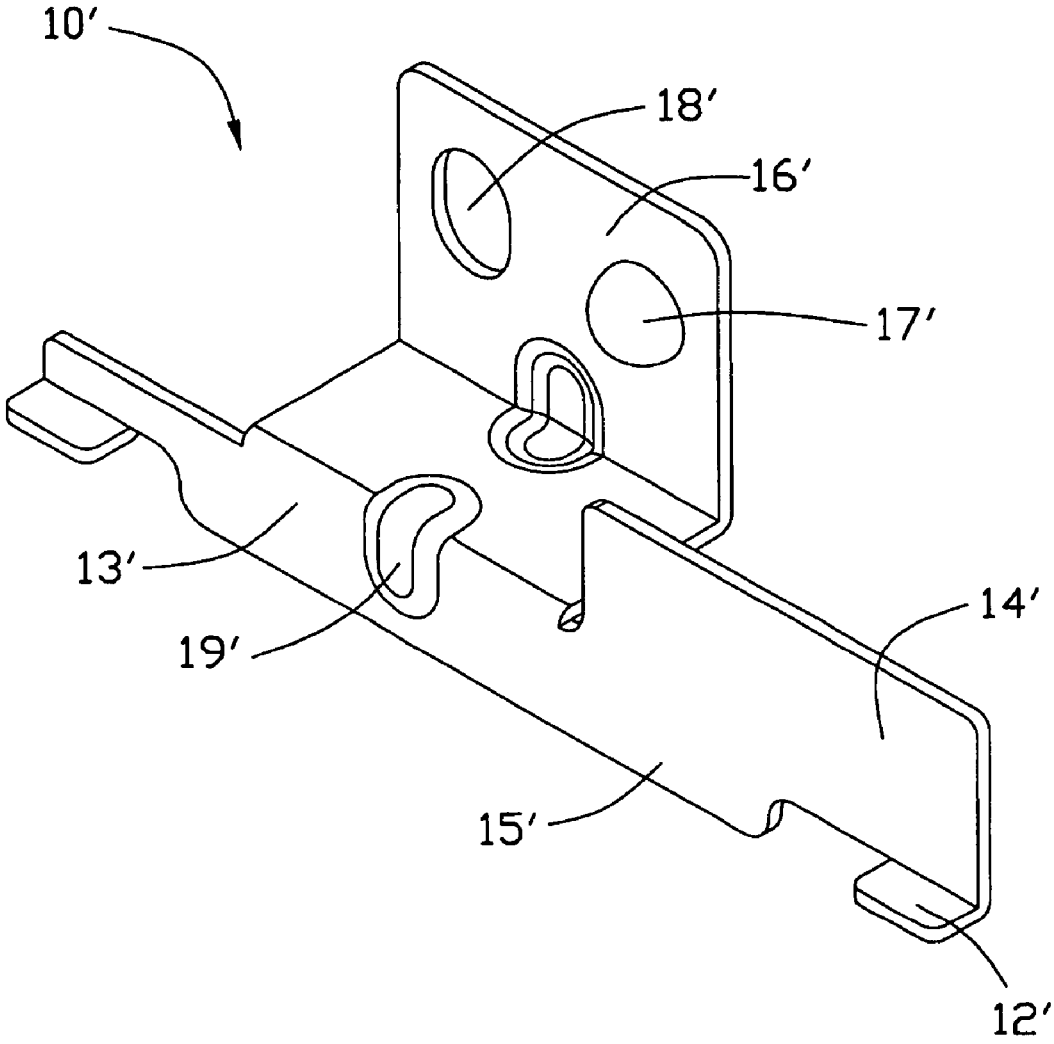
FIG. 4 is an isometric view of a connector securing apparatus in accordance with a second embodiment of the present invention.

Referring to FIG. 4, a connector securing apparatus 10' in accordance with a second embodiment of the present invention is shown. The connector securing apparatus 10' is similar to the connector securing apparatus 10 of the first embodiment. The connector securing apparatus 10' includes a body portion 14', a pair of supporting portions 12' extending from opposite ends of the body portion 14', a tail 15' extends down from the body portion 14' between the supporting portions 12', and a securing portion 16' extending from a main portion 13' of the body portion 14'. The supporting portions 12' are bent from the body portion 14', and extend in an inward direction. The securing portion 16' is bent from the main portion 13', and initially extends in an outward direction and then in an upward direction. The tail 15' can be used to secure cables of the first connector 20. A positioning bulge 17' is formed on an inward face of the securing portion 16', and a locating hole 18' is defined in the securing portion 16'. Furthermore, the connector securing apparatus 10' has two protrusions 19'. One of the protrusions 19' straddles adjoining parts of the main portion 13' and the securing portion 16'. The other protrusion 19' straddles an angled part of the securing portion 16'. The protrusions 19' respectively and cooperatively enhance a mechanical strength of the connector securing apparatus 10'.

Finally, it is to be understood that the above-described embodiments are intended to illustrate rather than limit the invention. Variations may be made to the embodiments without departing from the spirit of the invention as claimed. The embodiments illustrate the invention but do not restrict the scope of the invention.

I claim:

1. A connector securing apparatus comprising:

a body portion having two opposite ends and a main portion;

a pair of supporting portions extending from the opposite ends of the body portion and bending along a first direction; and a securing portion extending from a single connection portion of the main portion of the body portion and initially bending outwardly along a second direction opposite to the first direction and then bending upwardly.

2. The connector securing apparatus as claimed in claim 1, wherein the supporting portions bend inwardly from the opposite ends.

3. The connector securing apparatus as claimed in claim 1, wherein a strengthening protrusion is formed at an angled part of the securing portion, and another strengthening protrusion is formed where the main portion adjoins the securing portion.

4. The connector securing apparatus as claimed in claim 1, wherein a positioning bulge is formed on the securing portion.

5. The connector securing apparatus as claimed in claim 1, wherein a locating hole is defined in the securing portion.

6. The connector securing apparatus as claimed in claim 1, wherein a tail extends down from the body portion between the supporting portions.

7. A liquid crystal display device comprising:

a first connector;

a housing having a second connector positioned therein, the first connector engaged with the second connector; and a connector securing apparatus comprising a body portion, a pair of supporting portions engaged with the first connector, and a securing portion fixed to the housing, wherein the supporting portions extend from opposite ends of the body portion, and the securing portion extends from a main portion of the body portion.

8. The liquid crystal display device as claimed in claim 7, wherein the supporting portions bend inwardly from the opposite ends of the body portion.

9. The liquid crystal display device as claimed in claim 7, wherein the securing portion initially bends outwardly and then upwardly from the main portion.

10. The liquid crystal display device as claimed in claim 9, wherein a strengthening protrusion is formed at an angled part of the securing portion, and another strengthening protrusion is formed where the main portion adjoins the securing portion.

11. The liquid crystal display device as claimed in claim 7, wherein a positioning bulge is formed on the securing portion, and the housing defines a corresponding positioning hole.

12. The liquid crystal display device as claimed in claim 7, wherein the securing portion defines a locating hole, and the housing defines a corresponding threaded hole.

13. The liquid crystal display device as claimed in claim 7, wherein a tail extends down from the body portion between the supporting portions.

14. An electronic device comprising:

an electronic component functioning for said electronic device and positioned in said electronic device, and comprising at least one electrical connector mounted thereon;

a matable electrical connector capable of electrically engaging with said at least one electrical connector of said electronic component;

a supportive means of said electronic device spaced from said electronic component with a distance larger than a total extension length away from said electronic component when said at least one electrical connector and said matable electrical connector electrically engage with each other beside said electronic component; and a connector securing apparatus engagable respectively with said supportive means and said matable electrical connector which is mated with said at least one electrical connector so as to secure mating of said matable electrical connector and said at least one electrical connector.

15. The electronic device as claimed in claim 14, wherein said electronic component is a circuit board, and said supportive means is a housing of said electronic device.

16. The electronic device as claimed in claim 14, wherein said connector securing apparatus extends a pair of supporting portions to engage with said matable electrical connector and a securing portion to engage with said supportive means.

17. The electronic device as claimed in claim 16, wherein said connector securing apparatus comprises a body portion, and said pair of supporting portions extends from said body portion along a first direction and said securing portion extends from said body portion along a second direction opposite to said first direction.

18. The electronic device as claimed in claim 16, wherein said pair of supporting portions extends for a first length and said securing portion extends for a second length, and a sum of said first length, said second length and said total extension length of said matable electrical connector and said at least one electrical connector is equal to said distance of said supportive means spaced from said electronic component.

* * * * *